US009243591B2

(12) United States Patent
Jentz et al.

(10) Patent No.: US 9,243,591 B2
(45) Date of Patent: Jan. 26, 2016

(54) FUEL SYSTEM DIAGNOSTICS

(75) Inventors: Robert Roy Jentz, Westland, MI (US); Mark W. Peters, Wolverine Lake, MI (US); Michael Casedy, Ann Arbor, MI (US); Aed M Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 807 days.

(21) Appl. No.: 13/610,720

(22) Filed: Sep. 11, 2012

(65) Prior Publication Data

US 2014/0069394 A1 Mar. 13, 2014

(51) Int. Cl.
*F02M 25/08* (2006.01)

(52) U.S. Cl.
CPC ..... *F02M 25/0809* (2013.01)

(58) Field of Classification Search
CPC ..... F02M 25/0809; F02M 25/08; F02M 25/0836; F02M 25/089; F02M 25/0818; F02D 41/0032
USPC ..... 123/516–521, 198 D, 198 DB; 73/114.39
See application file for complete search history.

(56) References Cited

U.S. PATENT DOCUMENTS 5,267,547 A * 12/1993 Chikamatsu ..... F02M 25/0809 123/198 D
5,297,529 A * 3/1994 Cook ..... F02M 25/0818 123/198 D
5,355,864 A * 10/1994 Kuroda ..... F02M 25/0809 123/198 D
5,614,665 A * 3/1997 Curran ..... F02M 25/0809 123/521
5,775,307 A * 7/1998 Isobe ..... F02M 25/0809 123/198 D
5,799,639 A * 9/1998 Isobe ..... F02M 25/0809 123/198 D
5,816,222 A * 10/1998 Kidokoro ..... F02M 25/0809 123/357
6,283,098 B1 9/2001 Corkill
6,321,727 B1 * 11/2001 Reddy ..... F02M 25/0809 123/520
6,536,261 B1 * 3/2003 Weldon ..... F02M 25/0809 123/520
6,738,709 B2 5/2004 Saito et al.
6,837,224 B2 1/2005 Kidokoro et al.
6,973,924 B1 12/2005 Suzuki
2001/0008136 A1 * 7/2001 Kitamura ..... F02M 25/0809 123/516
2002/0062820 A1 * 5/2002 Herm ..... F02D 41/22 123/520
2003/0192365 A1 * 10/2003 Perry ..... F02M 25/0809 73/49.7
2004/0055386 A1 * 3/2004 Everingham ..... F02M 25/0809 73/716
2005/0022584 A1 * 2/2005 De Ronne ..... F02D 33/003 73/49.7
2009/0277251 A1 * 11/2009 Takakura ..... F02M 25/0809 73/40.7

* cited by examiner

*Primary Examiner* — Thomas Moulis
(74) *Attorney, Agent, or Firm* — Julia Voutyras; Alleman Hall McCoy Russell & Tuttle LLP

(57) ABSTRACT

Methods and system are provided for identifying unintended closing (or corking) of a mechanical valve coupled to a fuel tank. If tank vent valve corking is identified during a leak test, fuel tank pressure data collected during the leak test is disregarded and not used to determine a fuel system leak. Instead, a fuel system leak test is repeated to improve reliability of test results.

20 Claims, 8 Drawing Sheets

FUEL SYSTEM DIAGNOSTICS

FIELD

The present description relates to systems and methods for improving accuracy of fuel system leak detection in a vehicle, such as a hybrid vehicle.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel.

Since leaks in the emissions control system can inadvertently allow fuel vapors to escape to the atmosphere, leak detection routines may be intermittently performed when the engine is not running. Therein, following application of a negative pressure on the fuel system, the system is sealed and a rate of pressure decay is monitored. By comparing the actual pressure decay to a reference value (as determined through a reference orifice), leaks may be identified. In addition, to avoid false positive leak determination, vehicle control systems may abort or delay leak tests if selected conditions are met.

One example approach for reducing false positive leak determination is shown by Suzuki in U.S. Pat. No. 6,973,924. Therein, if refueling of a fuel tank is determined, a leak check routine is delayed until a threshold amount of canister purging has occurred. Specifically, a leak check is not carried out during conditions where a large amount of evaporative fuel is generated due to refueling since the refueling vapors can increase the possibility of a false positive leak determination.

However, the inventors herein have identified potential issues with such an approach. As one example, the approach of Suzuki may not sufficiently address false leak detections occurring due to unintended temporary closing (also referred to as corking) of mechanical fuel tank vent valve(s). In particular, engine-on leak diagnostics may be performed while a vehicle is moving. Therein, the leak diagnostics may be affected by vehicle dynamic maneuvers, such as sweeping turns, climbing of an elevation, or travel along a bumpy road, wherein fuel may slosh and momentarily cork one or more passive tank vent valves (which are otherwise expected to be open during leak diagnostics). When this occurs, the fuel tank may become isolated and the volume of the evaporative system is dramatically reduced. If a leak test is running when the unintended valve closing occurs, false leak detection may occur because leak detection reference pressure values are based on a fuel tank fill volume. As a result, if a fuel tank becomes isolated due to unintended temporary closing of a fuel tank vent valve, the likelihood of false leak detection increases. This reduces the reliability of the leak test while increasing an MIL warranty.

In one example, some of the above issues may be addressed by a method for a vehicle fuel system, comprising: during a fuel system leak test, and in response to unintended temporary closing of a mechanical valve coupled to a fuel tank, not completing the fuel system leak test. Rather, a leak test may be reiterated so that false leak detections are reduced.

As an example, an engine fuel system leak test may be initiated by opening a purge valve. As such, during the leak test, one or more passive, mechanical vent valves coupled to the fuel tank are expected to be open. An engine intake vacuum may then be applied on the fuel system. As vacuum is being pulled down in the fuel tank, the fuel tank pressure may be monitored. A sudden inflection in fuel tank pressure experienced during the (first, or initial) vacuum pull-down may indicate an unintended temporary closing (herein also referred to as corking) and subsequent opening (herein also referred to as uncorking) of a fuel tank vent valve. For example, vacuum may suddenly be pulled down faster than expected, suggested unintended closing of a vent valve, followed by a sudden decrease back to the expected profile, suggested reopening of the vent valve. In one example, the leak test may be performed while a vehicle is moving, and the momentary closing of the vent valve may be induced by certain vehicle maneuvers (e.g., sweeping turns).

In response to the indication of unintended temporary vent valve closing, the fuel system leak test may be discontinued and not completed. Instead, the fuel tank vacuum may be released, the purge valve may be closed and fuel tank settings from prior to the leak test may be resumed. Then, once the fuel tank pressure has stabilized, the fuel system leak test may be re-initiated. Specifically, the purge valve may be re-opened and vacuum may be pulled down again in the fuel tank. If there is no pressure inflection during the (second or subsequent) vacuum pull-down, it may be determined that valve corking did not occur this time around. Accordingly, following the most recent application of vacuum, the fuel tank may be isolated (by closing the purge valve) and vacuum bleed-up to atmospheric pressure may be monitored. A fuel system leak may then be identified based on the rate of vacuum bleed-up. For example, if vacuum bleed-up is faster than a threshold rate, a fuel system leak is confirmed.

In other embodiments, unintended temporary closing of the fuel tank vent valve may be determined due to a pressure inflection experienced during the vacuum bleed-up. For example, vacuum may be bled-up faster than expected, suggested unintended closing of the vent valve, followed by a sudden decrease back to the expected profile, suggested reopening of the vent valve. If the indication is received during the vacuum bleed-up, the fuel system leak test may be discontinued and not completed. That is, the vacuum bleed-up data may be disregarded while initial fuel system settings (those priori to initiating the leak test) are resumed. Then, once the fuel tank pressure stabilizes, the fuel system leak test may be re-initiated. Specifically, vacuum may be pulled down again in the fuel tank. If there is no pressure inflection during the vacuum pull-down and the subsequent vacuum bleed-up, it may be determined that valve corking did not occur this time around. Accordingly, the most recent vacuum bleed-up data may be used to identify a fuel system leak.

In this way, by aborting a fuel system leak test if an unintended momentary closing of a fuel tank vent valve is detected, false leak detections may be reduced. By resuming initial pre-test fuel system settings, and retrying the leak test once fuel tank pressures have stabilized following the aborted leak test, leak tests may be completed with more reliable results. By relying only on vacuum bleed-up data from a leak test when valve corking was not determined, fuel system leaks may be accurately and reliably identified.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

DETAILED DESCRIPTION

Figure 1:
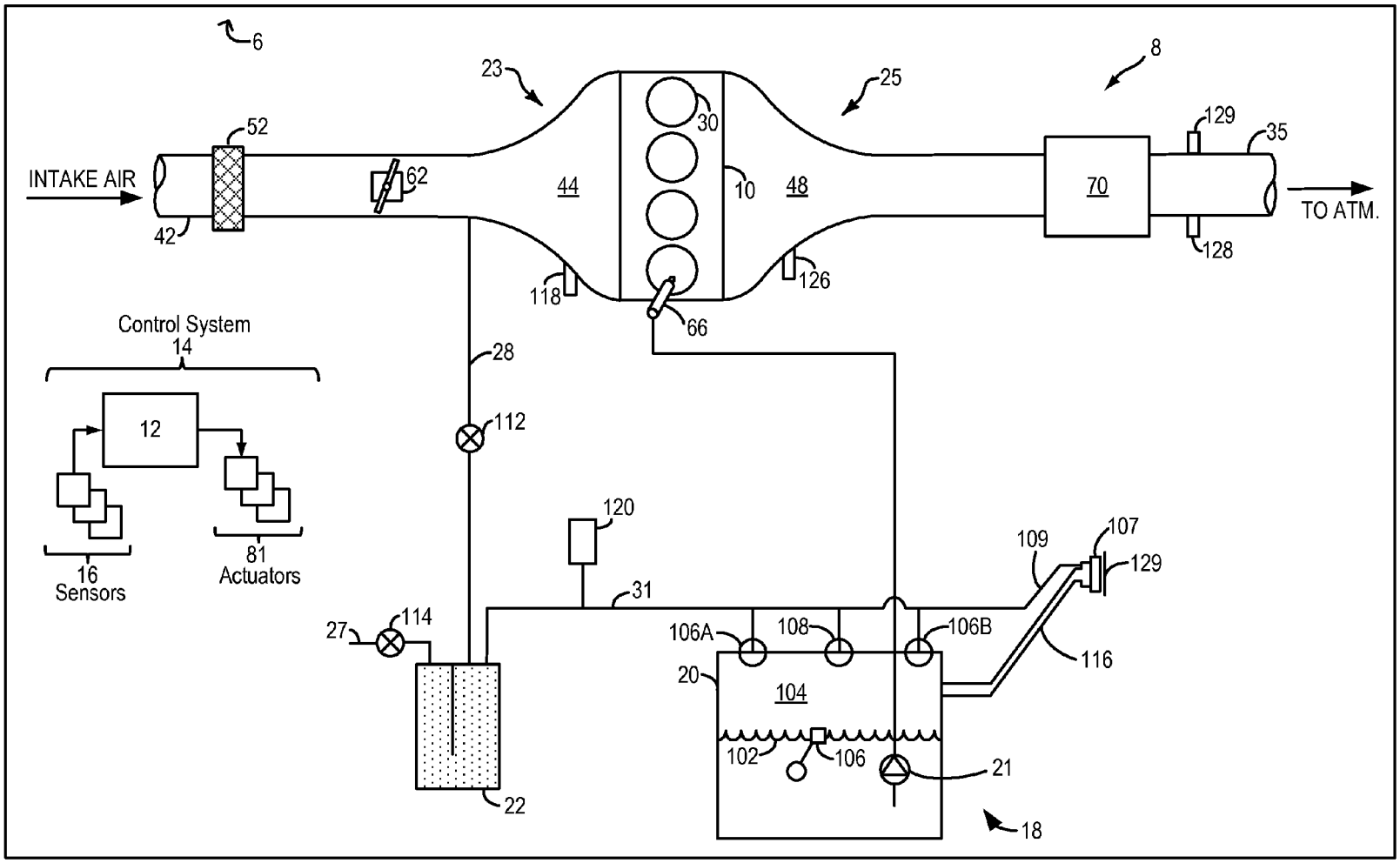
FIG. 1 shows a schematic depiction of a vehicle fuel system.

Methods and systems are provided for identifying leaks in a fuel system coupled to a vehicle engine, such as the fuel system of FIG. 1. An engine-on negative pressure leak test may be performed on the fuel system while the vehicle is moving. A controller may be configured to perform a control routine, such as the example routine of FIG. 2, to apply engine intake vacuum on the fuel system and determine a fuel system leak based on a rate of subsequent vacuum bleed-up. The controller may perform a routine, such as the routine of FIG. 3, to identify temporary unintended closing of a fuel tank vent valve based on fuel tank pressure inflections experienced during a vacuum pull-down or vacuum bleed-up phase of the leak test. The controller may complete the leak test only if no pressure inflections are experienced during the leak test. Else, if a temporary unintended closing of a fuel tank vent valve is determined during the leak test, the controller may discontinue the leak test and retry it at a later time. Example pressure deviations and inflections in fuel tank pressure resulting from momentary tank vent valve corking are shown with reference to FIGS. 5-11 and compared to an expected leak test pressure profile shown at FIG. 4. An example leak test operation is described at FIG. 12. In this way, false leak detections may be reduced and reliability of a fuel system leak test can be improved.

FIG. 1 shows a schematic depiction of a hybrid vehicle system 6 that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. Fuel tank 20 receives fuel via a refueling line 116, which acts as a passageway between the fuel tank 20 and a refueling door 129 on an outer body of the vehicle. During a fuel tank refueling event, fuel may be pumped into the vehicle from an external source through refueling inlet 107. During a refueling event, one or more fuel tank vent valves 106A, 106B, 108 (described below in further details) may be open to allow refueling vapors to be directed to, and stored in, canister 22.

Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system.

Vapors generated in fuel tank 20 may be routed to fuel vapor canister 22, via conduit 31, before being purged to the engine intake 23. Fuel tank 20 may include one or more vent valves for venting diurnals and refueling vapors generated in the fuel tank to fuel vapor canister 22. The one or more vent valves may be electronically or mechanically actuated valve and may include active vent valves (that is, valves with moving parts that are actuated open or close by a controller) or passive valves (that is, valves with no moving parts that are actuated open or close passively based on a tank fill level). In the depicted example, fuel tank 20 includes gas vent valves (GVV) 106A, 106B at either end of fuel tank 20 and a fuel level vent valve (FLVV) 108, all of which are passive vent valves. Each of the vent valves 106A, 106B, 108 may include a tube (not shown) that dips to a varying degree into a vapor space 104 of the fuel tank. Based on a fuel level 102 relative to vapor space 104 in the fuel tank, the vent valves may be open or closed. For example, GVV 106A, 106B may dip less into vapor space 104 such that they are normally open. This allows diurnal and "running loss" vapors from the fuel tank to be released into canister 22, preventing over-pressurizing of the fuel tank. However, during vehicle operation on an incline, when a fuel level 102 on at least one side of the fuel tank is artificially raised, vent valve 106A, 106B may close to prevent liquid fuel from entering vapor line 31. As another example, FLVV 108 may dip further into vapor space 104 such that it is normally open. This allows fuel tank overfilling to be prevented. In particular, during fuel tank refilling, when a fuel level 102 is raised, vent valve 108 may close, causing pressure to build in vapor line 109 (which is downstream of refueling inlet 107 and coupled thereon to conduit 31) as well as at a filler nozzle coupled to the fuel pump. The increase in pressure at the filler nozzle may then trip the refueling pump, stopping the fuel dill process automatically, and preventing overfilling.

An issue with the passive tank vent valves is that during selected vehicle maneuvers, such as sweeping turns, climbing of an elevation, or travel along a bumpy road, fuel may slosh and momentarily, and unintentionally close the valve that was otherwise expected to be open. Further maneuvers may likewise cause the valve to re-open again. When a vent valve is temporarily corked, the fuel tank may become isolated, dramatically reducing the volume of the fuel system. If unintentional closing of a fuel tank vent valve occurs during a fuel system leak test (elaborated below), leak test data may be corrupted and false diagnostic codes may be triggered. As elaborated below and with reference to FIGS. 2-3, engine control systems may be configured to identify vent valve corking during a leak test based on deviations in fuel tank pressure profiles during the leak test, and in response to identification of a vent valve being closed when it was expected to be open, the leak test is aborted and retried. This reduces the likelihood of false leak detection and improves vehicle fuel system warranties.

It will be appreciated that while the depicted embodiment shows vent valves 106A, 106B, 108 as passive valves, in alternate embodiments, one or more of them may be configured as electronic valves electronically coupled to a controller (e.g., via wiring). Therein, a controller may send a signal to actuate the vent valves open or close. In addition, the valves may include electronic feedback to communicate an open/close status to the controller. While the use of electronic vent valves having electronic feedback may enable a controller to directly determine whether a vent valve is open or closed (e.g., to determine if a valve is closed when it was supposed to be open), such electronic valves may add substantial costs to the fuel system. Also, the wiring required to couple such electronic vent valves to the controller may act as a potential ignition source inside the fuel tank, increasing fire hazards in the fuel system. Thus, by using passive fuel tank vent valves and monitoring fuel tank pressures during a leak test, vent valve corking may be identified reliably without increasing fuel system fire risks.

Returning to FIG. 1, fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 via purge line 28 by opening canister purge valve 112. While a single canister 22 is shown, it will be appreciated that fuel system 18 may include any number of canisters.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, in some embodiments, a fuel tank isolation valve (not shown) may be optionally included in conduit 31 such that fuel tank 20 is coupled to canister 22 via the isolation valve. When included, the isolation valve may be kept closed during engine operation so as to limit the amount of diurnal vapors directed to canister 22 from fuel tank 20. During refueling operations, and selected purging conditions, the isolation valve may be temporarily opened to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled between the fuel tank and canister 22, in alternate embodiments, the pressure sensor may be directly coupled to fuel tank 20.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode wherein the controller 12 may close canister purge valve (CPV) 112 and open canister vent valve 114 to direct refueling and diurnal vapors into canister 22 while preventing fuel vapors from being directed into the intake manifold. As another example, the fuel system may be operated in a refueling mode (e.g., when fuel tank refueling is requested by a vehicle operator), wherein the controller 12 may maintain canister purge valve 112 closed, to depressurize the fuel tank before allowing enabling fuel to be added therein. As such, during both fuel storage and refueling modes, the fuel tank vent valves 106A, 106B, and 108 are assumed to be open.

As yet another example, the fuel system may be operated in a canister purging mode (e.g., after an emission control device light-off temperature has been attained and with the engine running), wherein the controller 12 may open canister purge valve 112 and open canister vent valve 11. As such, during the canister purging, the fuel tank vent valves 106A, 106B, and 108 are assumed to be open (though is some embodiments, some combination of valves may be closed). During this mode, vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Controller 12 may also be configured to intermittently perform leak detection routines on fuel system 18 to confirm that the fuel system is not degraded. As such, leak detection routines may be performed while the vehicle is running with the engine on (e.g., during an engine mode of hybrid vehicle operation) or with the engine off (e.g., during a battery mode of hybrid vehicle operation). Leak tests performed while the engine is off may include applying an engine-off natural vacuum on the fuel system. Therein, the fuel tank may be sealed when the engine is turned off by closing the canister purge valve and canister vent valve. As the fuel tank cools down, vacuum is generated in the vapor space of the fuel tank (due to the relation between temperature and pressure of gases). Then, the canister vent valve is opened and a rate of vacuum decay from the fuel tank is monitored. If the fuel tank pressure stabilizes to atmospheric pressure faster than expected, a fuel system leak is determined. Leak tests performed while the engine is on may include applying an engine intake vacuum on the fuel system for a duration (e.g., until a target fuel tank vacuum is reached) and then sealing the fuel system while monitoring a change in fuel tank pressure (e.g., a rate of decay in the vacuum level, or a final pressure value). A fuel system leak may be identified based on a rate of vacuum bleed-up to atmospheric pressure, as elaborated below.

To perform the leak test, negative pressure generated at intake manifold 44 may be applied on the fuel system. Specifically, canister purge valve 112 and canister vent valve 114 may be opened while fuel tank vent valves 106A, 106B, 108 remain open so that a vacuum is drawn from intake manifold 44 along purge line 28. Then, after a threshold fuel tank negative pressure has been reached, the canister purge valve and canister vent valve may be closed, while the tank vent valves remain open, and a fuel tank pressure bleed-up is monitored at pressure sensor 120. Based on the pressure bleed-up rate (or vacuum decay rate) and the final stabilized fuel tank pressure following the application of engine intake vacuum, the presence of a fuel system leak may be determined. For example, in response to a vacuum bleed-up rate that is faster than a threshold rate, a leak may be determined and fuel system degradation may be indicated.

However, if any of the fuel tank vent valves 106A, 106B, 108 is momentarily corked (that is, unintentionally closed) during the leak test, the fuel tank becomes isolated and the volume of the fuel system is dramatically reduced. Since leak detection reference/threshold pressure values are based on a fuel tank fill volume, when the fuel tank becomes isolated due to unintended temporary closing of a fuel tank vent valve, the likelihood of false leak detection increases. As elaborated below, during such conditions, a leak test may be aborted and reiterated so that only non-corrupted fuel system data is relied on for leak identification.

Returning to FIG. 1, vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, and pressure sensor 129. Other sensors such as additional pressure, temperature, air/fuel ratio, and composition sensors may be coupled to various locations in the vehicle system 6. As another example, the actuators may include fuel injector 66, canister purge valve 112, canister vent valve 114, and throttle 62. The control system 14 may include a controller 12. The controller may receive input data from the various sensors, process the input data, and trigger the actuators in response to the processed input data based on instruction or code programmed therein corresponding to one or more routines. Example control routines are described herein with regard to FIGS. 2-3.

In this way, the system of FIG. 1 enables a method for a vehicle fuel system wherein during a fuel system leak test, and in response to unintended temporary closing of a mechanical valve coupled to a fuel tank, the fuel system leak test is not completed. Instead, fuel system settings may be reset and a fuel system leak test may be retried.

Figure 2:
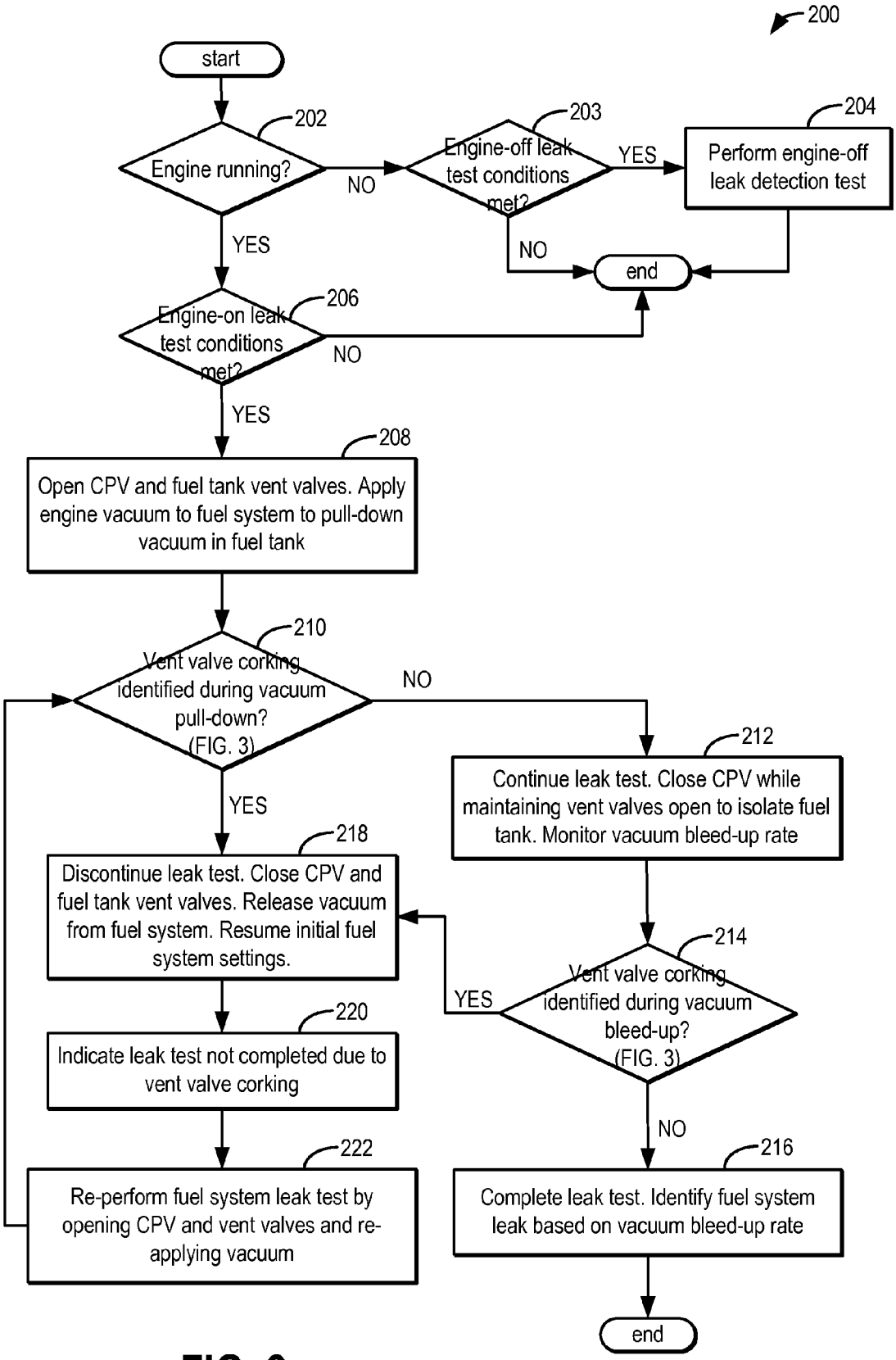
FIG. 2 shows a high level flow chart illustrating a routine that may be implemented for performing a fuel system leak test.

Now turning to FIG. 2, an example routine 200 is shown for applying negative pressure on a fuel system and identifying a fuel system leak based on a change in fuel system pressure following the application of the negative pressure. In addition, if an unintended temporary closing (or corking) of a fuel tank vent valve is identified during the fuel system leak test, to improve the reliability of leak test results, the leak test is aborted, and retried at a later time.

At 202, it may be confirmed that the engine is running. For example, it may be confirmed that the vehicle is operating in an engine-on mode wherein the vehicle is being propelled using power from the engine. If the engine is not running, at 203, engine-off leak test conditions may be confirmed. These may include confirming that a fuel tank temperature is within a threshold range, that a threshold duration since engine-off has elapsed, and a threshold duration since a last leak test has elapsed.

Upon confirming engine-off leak test conditions, at 204, the routine includes performing an engine-off leak detection test. As such, this includes identifying fuel system leaks by applying an engine-off natural vacuum on the fuel system. In particular, the fuel tank may be sealed when the engine is turned off by closing the canister purge valve and canister vent valve. As the fuel tank cools down, vacuum is generated in the vapor space of the fuel tank (due to the relation between temperature and pressure of gases). Then, the canister vent valve is opened and a rate of vacuum decay from the fuel tank is monitored. If the fuel tank pressure stabilizes to atmospheric pressure faster than expected, a fuel system leak is determined.

If the engine is running, then at 206 it may be determined if engine-on leak test conditions have been met. Entry conditions for leak detection may include a variety of engine and/or fuel system operating conditions and parameters. Additionally, entry conditions for leak detection may include a variety of vehicle conditions.

For example, entry conditions for engine-on leak detection may include a fuel level in the fuel tank being above a threshold level, a temperature of one or more fuel system components being within a predetermined temperature range (since temperatures which are too hot or too cold may decrease accuracy of leakage detection), and a threshold amount of time/traveled distance having elapsed since a prior leak test. In one example, leak testing may be performed after a vehicle has traveled a preset amount of miles since a previous leak test or after a preset duration has passed since a previous leak test. If engine-on leak test entry conditions are not met, the routine may end.

Upon confirming engine-on leak test conditions, at 208, a fuel system leak test may be initiated. Therein, a canister purge valve (CPV) may be opened so that an engine intake manifold vacuum can be applied on the fuel system, specifically, on the fuel tank via the canister. In addition a canister vent valve (CVV) may be closed to isolate the fuel system from the atmosphere. As such, while the vacuum is applied, the one or more passive tank vent valves (such as valves 106A, 106B, and 108 of FIG. 1) may be assumed to be open. The engine intake vacuum is then applied to the fuel system to pull-down vacuum in the fuel tank, for example, to a threshold vacuum level (or for a threshold duration). As such, this is also referred to as the vacuum pull-down phase of the fuel system leak test. As elaborated below, following the vacuum pull-down phase, the fuel system may be isolated and a rate of vacuum decay is monitored to identify leaks. Specifically, based on the rate at which fuel tank vacuum bleeds up to atmospheric pressure (also referred to as the vacuum bleed-up phase of the fuel system leak test), a fuel system leak is identified.

As such, engine-on leak tests may be performed while a vehicle is moving (for example, while a hybrid vehicle is moving in an engine-on mode and while the vehicle cruising is at steady-state vehicle speeds, e.g., at 40 mph). The inventors here have recognized that an unintended temporary closing of the fuel tank vent valves (the mechanical valves coupled to the fuel tank) may be caused by sources external to the fuel system, such as certain vehicle maneuvers performed while the vehicle is moving. For example, during vehicle maneuvers such as a sweeping left turns or right turns (e.g., vehicle turns at speeds that are higher than a threshold speed and/or vehicle turns at higher than threshold turn speeds), uphill vehicle travel (e.g., vehicle travel along an incline that is higher than a threshold grade), and travel along a bumpy road (e.g., vehicle travel along a track having a lower than threshold smoothness), fuel can slosh and momentarily shift the passive vent valves to a closed position. Still other maneuvers that may cause fuel sloshing and momentary closing of a fuel tank vent valve include vehicle travel along undulating track surfaces, aggressive braking maneuvers, and vehicle acceleration along any axis. If any of the fuel tank vent valves undergo momentary valve corking while a leak test is being performed, the leak test results may be corrupted. Specifically, momentary unintended closing of any of the passive fuel tank vent valves can cause the fuel tank to become isolated from the rest of the fuel system. This, in turn, reduces the volume of the fuel system. Since thresholds used for vacuum pull-down and/or bleed-up phases of a leak test are a function of the fuel tank fill volume, when the fuel tank becomes isolated (due to the temporary vent valve corking), false positive leak detection may occur and false diagnostic codes may be set. As a consequence, the leak diagnostic becomes less robust and less reliable while an MIL warranty is increased.

Therefore to improve the reliability of leak test results, in response to unintended temporary closing of a fuel tank vent valve during a given leak test, all the leak test data collected during the given leak test cycle may be disregarded, original (pre-test) fuel system settings may be resumed, and a leak test may be reiterated (until a complete leak test can be performed with no indication of vent valve corking).

Returning to FIG. 2, at 210, during the vacuum pull-down phase of the leak test, it may be determined if vent valve corking has been identified. Specifically, it may be determined if there is any temporary unintended closing of one or more mechanical valves coupled to the fuel tank, the unintended closing due to sources external to the fuel system (as discussed above). It may be also be determined if there is a subsequent closing of the valves following the momentary unintended opening. As such, the vent valves may be momentarily and unintentionally opened and closed multiple times during the vacuum pull-down phase of the leak test based on vehicle maneuvers executed while the leak test is being performed. As elaborated at FIG. 3, a controller may identify the unintended momentary opening and closing (and re-opening and re-closing) of the fuel tank vent valves during the vacuum pull-down phase based on the presence of fuel tank pressure inflections during the vacuum pull-down phase, the timing or location of the inflection points, as well as the rate of vacuum change during the vacuum pull-down phase. For example, the identification of unintended temporary closing of the mechanical valve during the applying of vacuum to the fuel tank may be based on at least one of the presence of inflection in fuel tank pressure during the applying of vacuum to the fuel tank and a rate of vacuum pull-down during the applying of vacuum being higher than a (first) threshold rate. Likewise, re-opening of the temporarily closed vent valve during the applying of vacuum may be indicated based on the inflection or a sudden decrease in the rate of vacuum pull-down. As such, one or more (e.g., multiple) inflections may be experienced during the applying of vacuum to the fuel tank, as elaborated herein.

If vent valve corking during the vacuum pull-down is confirmed, then at 218, the routine includes discontinuing and not completing the leak test. Not completing the fuel system leak test includes resuming (original) fuel system settings from before the leak test was initiated. For example, the CVV may be opened, CPV may be closed, and other fuel system valves that were actuated closed during the leak test may be actuated open (and vice versa). By returning the valves to their original (pre-test) settings, the vacuum applied on the fuel tank is allowed to bleed up towards atmospheric pressure conditions. Not completing the fuel system leak test further includes disregarding all the pressure data collected during the applying of vacuum to the fuel tank and the subsequent vacuum bleed-up and not indicating a fuel system leak based on the rate of vacuum bleed-up. In addition, at 220, a diagnostic code may be set to indicate that the leak test was not completed due to fuel tank vent valve corking.

Next, at 222, after resuming original fuel system settings, the leak test may be reiterated. In particular, the CPV may be re-opened, the CVV may be re-closed, and the fuel tank vent valves may be assumed to be open. Retrying the leak test further includes re-applying engine intake vacuum to the fuel tank with the fuel tank mechanical valves assumed open, and following the re-application, re-monitoring the vacuum pull-down and subsequent vacuum bleed-up in the fuel tank. As such, the routine may continue to abort completion of a fuel system leak test if vent valve corking is identified during the subsequent vacuum pull-down(s). If no vent valve corking occurs during the vacuum pull-down on the leak test retrial, the routine may proceed to 212 to re-isolate the fuel tank with the mechanical valve assumed open and re-monitor the vacuum bleed-up. The routine may then indicate fuel system leak based on the vacuum bleed-up during the re-monitoring if no further vent valve corking is identified (as elaborated below).

Returning to 210, if no vent valve corking is identified during the vacuum pull-down (on an initial leak test attempt initiated at 208, or a subsequent leak test reiteration initiated at 222), the routine proceeds to 212 to proceed with executing the vacuum bleed-up phase of the leak test. Therein, the routine includes, following the application of a threshold amount of vacuum to the fuel tank, isolating the fuel tank by closing the CPV while maintaining the CVV closed and while the fuel tank vent valves are assumed open. A subsequent vacuum bleed-up to atmospheric pressure is monitored.

At 214, during the vacuum bleed-up phase of the leak test, it may be determined if vent valve corking has been identified. Specifically, it may be determined if there is any temporary unintended closing of one or more mechanical valves coupled to the fuel tank, the unintended closing due to sources external to the fuel system (as discussed earlier). It may be also be determined if there is a subsequent unintended opening of the valves back to their original settings during the vacuum bleed-up phase. As such, the vent valves may be momentarily and unintentionally opened and closed multiple times during the vacuum bleed-up phase of the leak test based on vehicle maneuvers executed while the leak test is being performed. As elaborated at FIG. 3, a controller may identify the unintended momentary opening and closing (and re-opening and re-closing) of the fuel tank vent valves during the vacuum bleed-up phase based on the presence of fuel tank pressure inflections during the vacuum bleed-up phase, the timing or location of the inflection points, as well as the rate of vacuum change during the vacuum bleed-up phase. For example, the identification of unintended temporary closing of the mechanical valve during the bleeding up of vacuum in the isolated fuel tank may be based on at least one of the presence of inflection in fuel tank pressure during the isolating of the fuel tank and a rate of vacuum bleed-up during the isolating of the fuel tank being higher than a (second, different) threshold rate. Likewise, re-opening of the temporarily closed vent valve during the isolating the fuel tank may be indicated based on the pressure inflection or a sudden decrease in the rate of vacuum bleed-up. As such, one or more (e.g., multiple) inflections may be experienced during the vacuum bleed-up phase, as elaborated herein.

If vent valve corking during the vacuum bleed-up is confirmed, the routine returns to 218 to discontinue the leak test. In addition, a diagnostic code may be set to indicate that the leak test was not completed due to fuel tank vent valve corking. As elaborated earlier, original (pre-test) fuel system settings may be resumed, vacuum bleed-up to atmospheric pressure may be enabled, and pressure data collected thus far during the leak test may be disregarded so that a fuel system leak is not determined based on the vacuum bleed-up. Then, the fuel leak test may be reiterated (at 222). As such, the routine may continue to abort completion of a fuel system leak test if vent valve corking is identified during the vacuum bleed-up.

If no vent valve corking occurs during the vacuum bleed-up on the leak test retrial, the routine may proceed to 216 to complete the leak test. Therein, vacuum bleed-up during the isolating of the fuel tank may be monitored and a fuel system leak may be identified based on a rate of vacuum bleed-up (e.g., based on the vacuum bleed-up rate being higher than a threshold rate). In some embodiments, an orifice size of the leak may also be determined based on a deviation of the monitored vacuum bleed-up rate from the threshold rate.

In this way, leak detection may be identified based on vacuum bleed-up in an isolated fuel tank only if no unintended temporary closing of a fuel tank vent valve is determined during each of a fuel tank vacuum pull-down phase and vacuum bleed-up phase of the leak test. By discontinuing a leak test if momentary tank vent valve corking is identified, and reiterating the leak test, false leak detections can be reduced and leak test reliability is improved.

Figure 3:
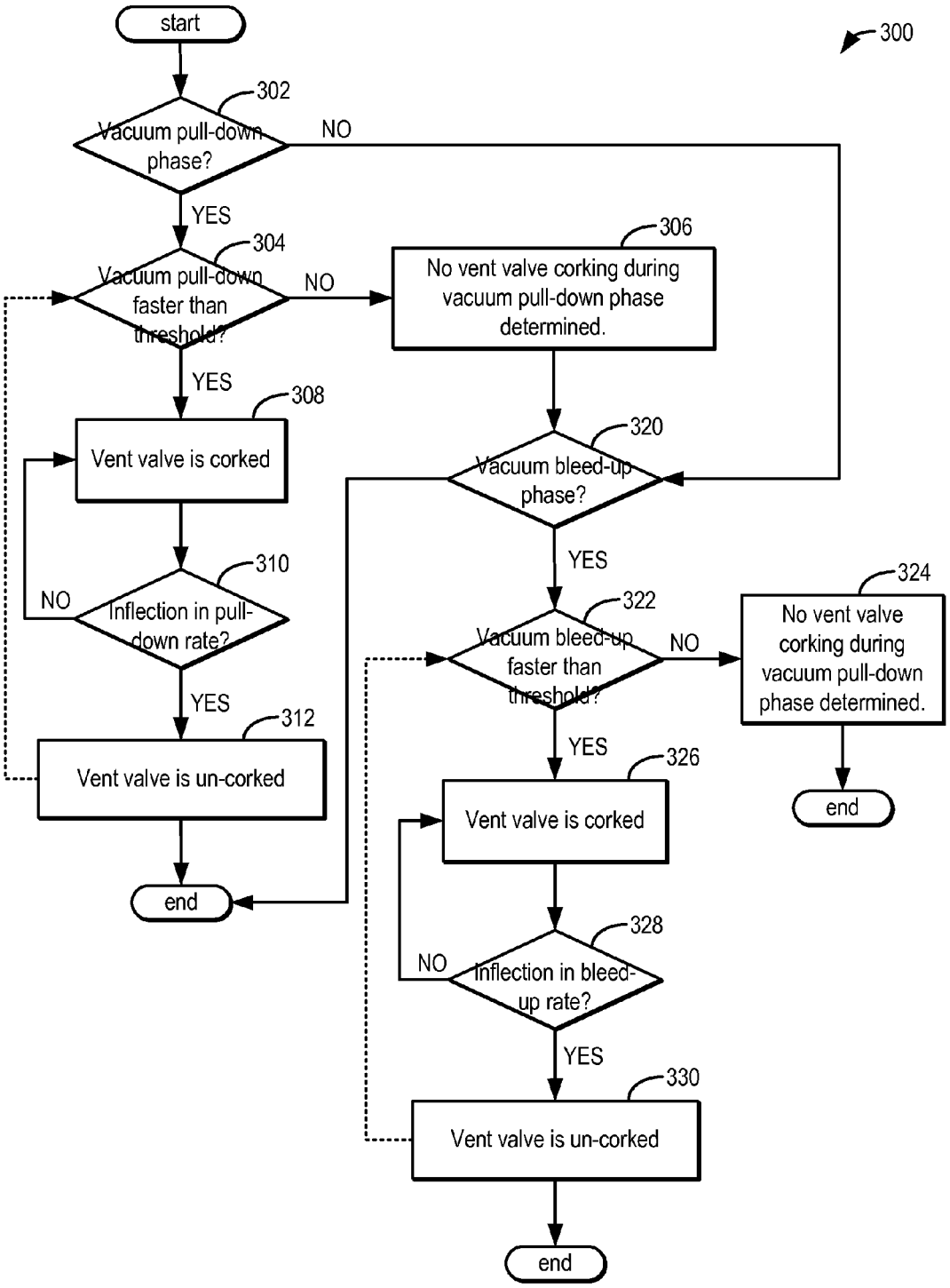
FIG. 3 shows a high level flow chart illustrating a routine that may be implemented for identifying unintended temporary opening of a fuel tank vent valve during the leak test of FIG. 2.

Now turning to FIG. 3, an example routine 300 is shown for identifying fuel tank vent valve corking. Therein, an unintended and temporary closing of a mechanical vent valve coupled to the fuel tank during either a vacuum pull-down or bleed-up phase of a leak test is identified based on changes in vacuum pull-down or bleed-up rates as well as the presence of pressure inflections during the vacuum pull-down or bleed-up phases. As elaborated below, an opening of the temporary closed vent valve, as well as unintended and temporary re-closing of the vent valve during the vacuum pull-down or bleed-up phases may also be determined. Example changes in vacuum pull-down or bleed-up rates that may be used to infer vent valve corking are elaborated subsequently at FIGS. 5-11 and compared to an expected pressure profile shown at FIG. 4.

At 302, the routine includes confirming a vacuum pull-down phase of the fuel system leak test. For example, it may be confirmed that the canister purge valve is open, a canister vent valve is closed, and that an engine intake vacuum is being applied on the fuel system (specifically, on the fuel tank via the canister). A vacuum pull-down rate may also be monitored during the applying of engine intake vacuum. For example, based on engine operating conditions, an amount of engine intake vacuum being generated and applied to the fuel system via a purge line (also referred to as a purge rate) may be estimated.

At 304, it may be determined if the vacuum pull-down rate is faster than a threshold rate. In one example, the threshold rate may be based on the estimated purge rate. If the vacuum pull-down rate is higher than the threshold rate, then at 308, it may be determined that vacuum is being pulled down in the fuel tank faster than expected due to an unintended and temporary closing of a fuel tank mechanical vent valve. In other words, it may be determined that a fuel tank vent valve is momentarily corked due to sources external to the fuel system, such as due to sudden and drastic vehicle maneuvers.

At 310, it may be determined if there is an inflection in the rate of vacuum pull-down. For example, it may be determined if there is a sudden change (e.g., sudden decrease) in the vacuum pull-down rate. If yes, then at 312, it may be determined that the fuel tank vent valve has un-corked. That is, the unintentionally closed vent valve has re-opened. Else, it may be determined that the valve is still corked. In one example, during the vacuum pull-down phase of the leak test, an initial vacuum pull down rate may be as expected. Then, in the middle of the vacuum pull-down phase, the vacuum pull-down rate may suddenly become elevated indicating a temporary closing of the vent valve. After a duration of vacuum pull-down at the elevated rate, the vacuum may have an inflection and the vacuum pull down rate may decrease back to the initial pull-down rate, indicating a reversal of the temporary valve closing. In another example, the vacuum pull-down rate may be elevated at the beginning of the vacuum pull-down phase.

As such, any of the one or more fuel tank vent valves may be unintentionally closed, and re-opened, multiple times during the vacuum pull-down phase. That is, multiple inflections may be experienced during the vacuum pull-down phase. Therefore, following the determination of vent valve uncorking at 312, the routine may return to 304 to determine if vent valve corking has re-occurred during the vacuum pull-down phase.

If vacuum pull-down is not faster than the threshold rate at 304, then at 306, it may be determined that no unintended temporary closing of the fuel tank vent valves has occurred during the vacuum pull-down phase of the leak test and the leak test may progress into the vacuum bleed-up phase.

Next, at 320, the routine includes confirming a vacuum bleed-up phase of the fuel system leak test. For example, it may be confirmed that the canister purge valve is closed, the canister vent valve is closed, the fuel tank is isolated, and that a threshold amount of engine intake vacuum has already been applied on the fuel system. For example, it may be confirmed that the fuel tank vacuum is at (or above) a threshold level of fuel tank vacuum. A vacuum bleed-up rate may also be monitored during the isolating of the fuel tank. For example, based on engine operating conditions, fuel system conditions, and ambient temperature and pressure conditions, a rate at which fuel tank vacuum is expected to be bleed up to atmospheric pressure may be estimated.

At 322, it may be determined if the vacuum pull-down rate is faster than a threshold rate. In one example, it may be determined if the vacuum pull-down rate is faster than each of a first threshold rate (the first threshold rate based on the expected rate of vacuum bleed-up from the fuel tank in the absence of any fuel system leaks), and a second threshold rate (the second threshold rate based on an expected rate of vacuum bleed-up in the presence of a fuel system leak and potentially different than the first threshold rate). In one example, the second threshold rate may be higher than the first threshold rate. If the vacuum bleed-up rate is higher than each of the first and second threshold rates, then at 326, it may be determined that vacuum is being bled from the fuel tank faster than expected due to an unintended and temporary closing of a fuel tank mechanical vent valve. In other words, it may be determined that a fuel tank vent valve is momentarily corked due to sources external to the fuel system, such as due to sudden and drastic vehicle maneuvers. This is because the vacuum bleed-up rate during a fuel tank valve corking event may be significantly larger than a vacuum bleed-up rate due to a leak in the fuel system.

At 328, it may be determined if there is an inflection in the rate of vacuum bleed-up. For example, it may be determined if there is a sudden change (e.g., sudden decrease) in the vacuum bleed-up rate. If yes, then at 330, it may be determined that the fuel tank vent valve has un-corked. That is, the unintentionally closed vent valve has re-opened. In one example, during the vacuum bleed-up phase of the leak test, an initial vacuum bleed-up rate may be as expected. Then, in the middle of the vacuum bleed-up phase, the vacuum bleed-up rate may suddenly become elevated indicating a temporary closing of the vent valve. After a duration of vacuum bleed-up at the elevated rate, the vacuum may have an inflection and the vacuum bleed-up rate may decrease back to the initial bleed-up rate, indicating a reversal of the temporary valve closing. In alternate examples, the vacuum bleed-up rate may rise at the beginning of the vacuum bleed-up phase, such as during a transition from the vacuum pull down phase to the vacuum bleed-up phase.

As such, the one or more fuel tank vent valves may be unintentionally closed, and then re-opened multiple times during the vacuum bleed-up phase. That is, multiple inflections may be experienced during the vacuum bleed-up phase. Therefore, following the determination of vent valve uncorking at 330, the routine may return to 322 to determine if vent valve corking has re-occurred during the vacuum bleed-up phase.

If vacuum bleed-up is not faster than the threshold rate at 322, then at 324, it may be determined that no unintended temporary closing of the fuel tank vent valves has occurred during the vacuum bleed-up phase of the leak test.

It will be appreciated that while the above routine depicts identifying fuel tank vent valve corking based on a vacuum pull-down or bleed-up rate during a leak test, and identifying fuel tank vent valve uncorking based on a fuel tank pressure inflection, in still other embodiments, corking and uncorking of the vent valve may be directly inferred from fuel tank pressure inflections occurring during a vacuum pull-down and/or a vacuum bleed-up phase of a leak test. It will also be appreciated that while the above routine depicts identification of unintended temporary closing of the mechanical valve based on one or more inflections in fuel tank pressure during the applying of vacuum to the fuel tank, or one or more inflections in fuel tank pressure during the vacuum bleed-up, in still further embodiments, the identification of unintended temporary closing of the mechanical valve may be based on one or more inflections in fuel tank pressure during a period of fuel tank pressure stabilization.

Figure 4:
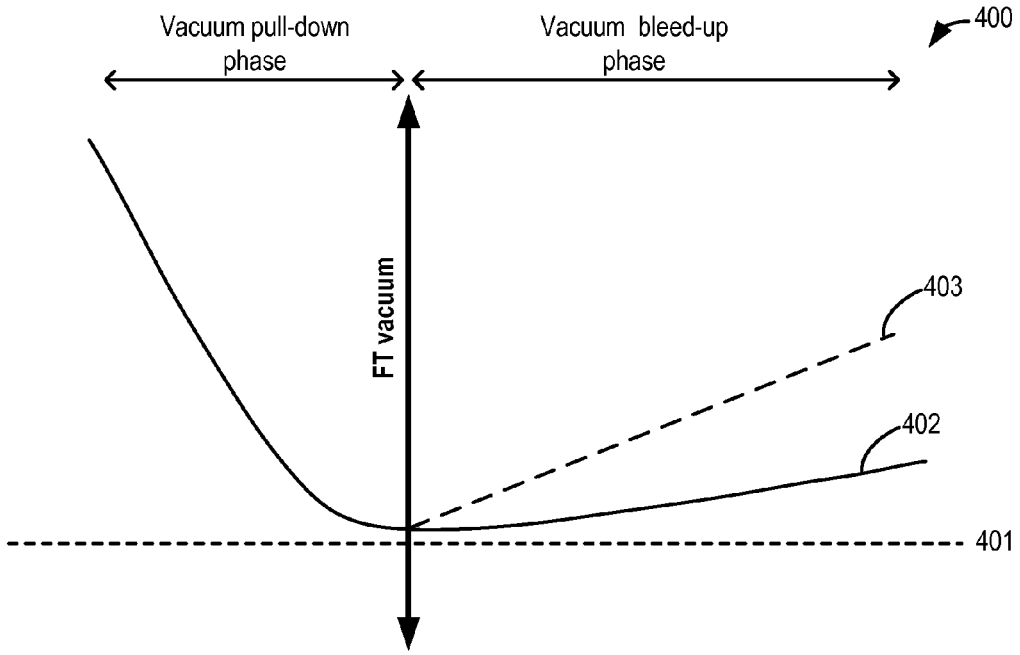
FIG. 4 shows an expected fuel tank pressure profile during a vacuum pull-down phase and a vacuum bleed-up phase of a fuel system leak test.

Now turning to FIGS. 4-11, example changes in a fuel tank vacuum level during vacuum pull-down and bleed-up phases of a leak test are shown. In particular, FIG. 4 shows an example of a leak test with no fuel tank vent valve corking occurring during the leak test, while FIGS. 5-11 show examples with one or more occurrences of fuel tank vent valve corking during the vacuum pull-down and/or bleed-up phases.

Map 400 of FIG. 4 shows an example change in fuel tank vacuum at plot 402 during a vacuum pull-down and bleed-up phase of a leak test. During the vacuum pull-down phase, vacuum (from an engine intake) is applied on the fuel tank to pull down vacuum into the fuel tank to a target or threshold vacuum level 401. For example, a canister purge valve may be actuated open to enable an engine intake vacuum to be applied on the fuel tank and the fuel tank pressure to be drawn down to the threshold vacuum level. Then, during the vacuum bleed-up phase, the fuel tank may be isolated and a rate of vacuum bleed-up to atmospheric pressure is monitored. For example, the canister purge valve may be actuated close to enable the fuel tank vacuum to decay from the threshold vacuum level. If there is no leak in the fuel system, fuel tank vacuum may bleed-up at a threshold rate, as shown by plot 402 (solid line). However, if there is a leak in the fuel system, fuel tank vacuum may bleed-up at a rate that is faster than the threshold rate as shown by plot 403 (dashed line).

Figure 5:
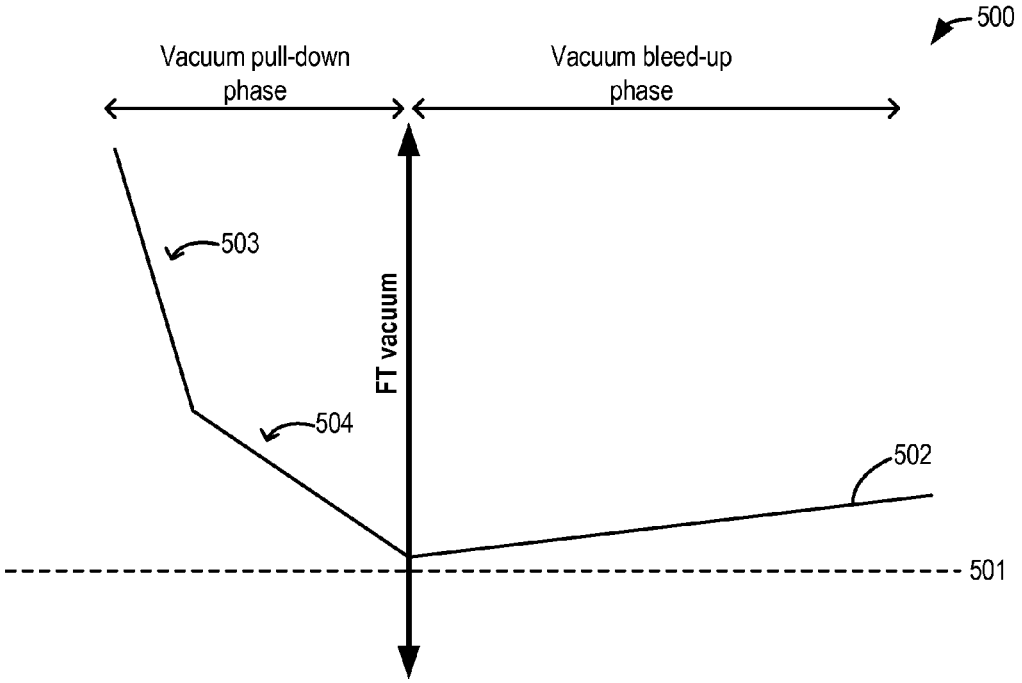
FIGS. 5-11 show deviations in a fuel tank pressure profile during one or more of the vacuum pull-down phase and vacuum bleed-up phase of a fuel system leak test caused due to momentary unintended opening and subsequent closing of a fuel tank vent valve.

Map 500 of FIG. 5 shows another example change in fuel tank vacuum at plot 502 during a vacuum pull-down and bleed-up phase of a leak test. Herein, during the vacuum pull-down phase, when vacuum is applied on the fuel tank to pull down vacuum to threshold vacuum level 501, a vacuum pull-down rate is higher than a threshold rate for a duration (as can be seen by comparing slope of plot 402 to slope of plot 502 during the vacuum pull-down phase of each leak test). In particular, segment 503 shows a region at the beginning of the vacuum pull-down phase where vacuum is pulled down at an elevated rate. In response to the higher than threshold vacuum pull-down rate, it may be determined that a fuel tank vent valve has closed unintentionally and temporarily (that is, a passive tank vent valve has corked). In addition, the high vacuum pull-down rate may trigger a blocked line code and cause vacuum to overshoot. For example, additional logic may be included in the controller to confirm that a blocked line exists. Then, in response to a sudden inflection in fuel tank vacuum, it may be determined that the vent valve has uncorked. Specifically, segment 504 shows a region in the middle of the vacuum pull-down phase where vacuum suddenly changes from being higher than the threshold rate to being lower than the threshold rate, and gradually returning towards an expected pressure profile. In the depicted example, the valve remains uncorked into and during the vacuum bleed-up phase. As elaborated at FIG. 2, in response to the indication of vent valve corking, the leak test may be discontinued and the fuel tank vacuum bleed-up rate of plot 502 may not be used to identify a fuel system leak. Rather, a leak test may be reiterated.

Figure 6:
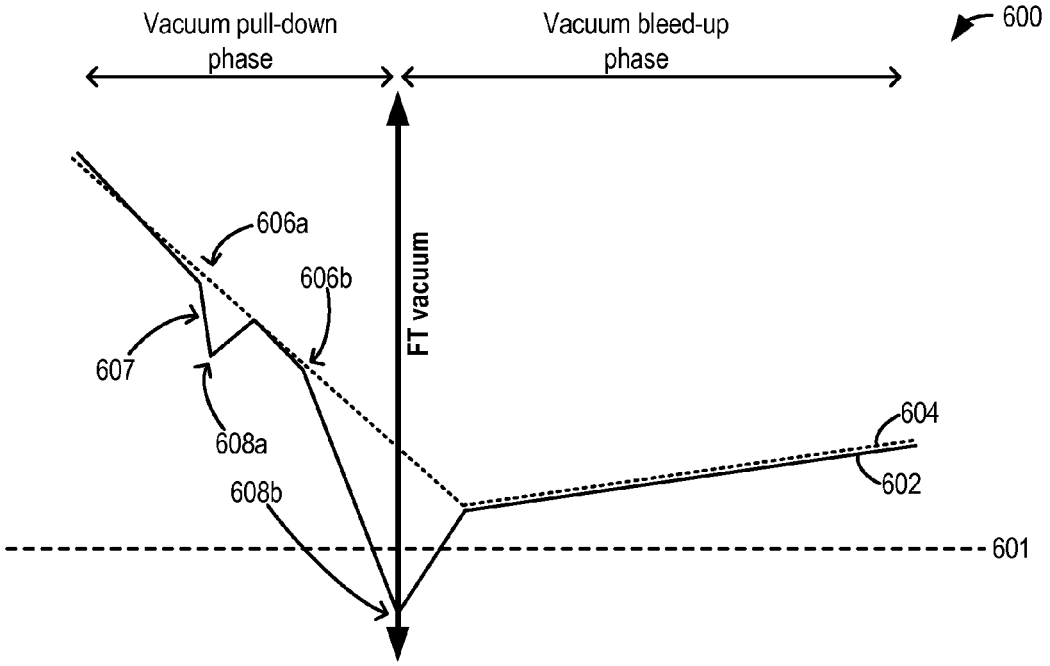

Map 600 of FIG. 6 shows another example change in fuel tank vacuum at plot 602 during a vacuum pull-down and bleed-up phase of a leak test. Herein, in the middle of the vacuum pull-down phase, while engine intake vacuum is applied on the fuel tank to pull down vacuum to threshold vacuum level 601, a vacuum pull-down rate is higher than a threshold rate for a duration (as can be seen by comparing the slope of plot 602 (solid line) to a slope of plot 402 (FIG. 4) during the vacuum pull-down phase of each leak test). In particular, segment 606*a* shows a first region of the vacuum pull-down phase where vacuum is pulled down faster than a threshold rate, substantially at a purge line vacuum level 607, while an actual fuel tank vacuum (plot 604, dotted line) is much lower. Herein, the rate of vacuum pull down is proportional to the volume being evaluated for a given manifold vacuum. In response to the higher than threshold vacuum pull-down rate, it may be determined that a first unintended fuel tank vent valve closing has occurred at 606*a* (that is, the valve has corked for a first time). Then, in response to a sudden inflection in fuel tank vacuum, it may be determined that the vent valve has uncorked. Specifically, segment 608*a* shows a first region of the vacuum pull-down phase where vacuum suddenly changes from being higher than the threshold rate to being lower than the threshold rate, and gradually returning towards an actual fuel tank vacuum level.

Segment 606*b* shows a second region in the middle of the vacuum pull-down phase where vacuum is pulled down faster than the threshold rate. In response to the higher than threshold vacuum pull-down rate, it may be determined that a second unintended fuel tank vent valve closing has occurred (that is, the valve has corked for a second time). Herein, the valve may remain corked for the remainder of the vacuum pull-down phase. As such, the high vacuum pull-down rate may also trigger a blocked line code or a large vacuum bleed-up depending upon the timing of the corking event. In one example, the controller may include additional logic to confirm that a blocked line exists. Then, during a transition into the vacuum bleed-up phase of the leak test, in response to a sudden inflection in fuel tank vacuum, it may be determined that the vent valve has uncorked. Specifically, segment 608*b* shows a first region at the onset of the vacuum bleed-up phase where the rate of change of vacuum suddenly inflects and approaches fuel tank vacuum. Thus, in the depicted example, the valve corks multiple times during the vacuum pull-down phase, and uncorks at the beginning of the vacuum bleed-up phase. As elaborated at FIG. 2, in response to the indication of (repeated) vent valve corking and uncorking, the leak test may be discontinued and the fuel tank vacuum bleed-up rate of plot 602 may not be used to identify a fuel system leak. Rather, a leak test may be reiterated.

Figure 7:
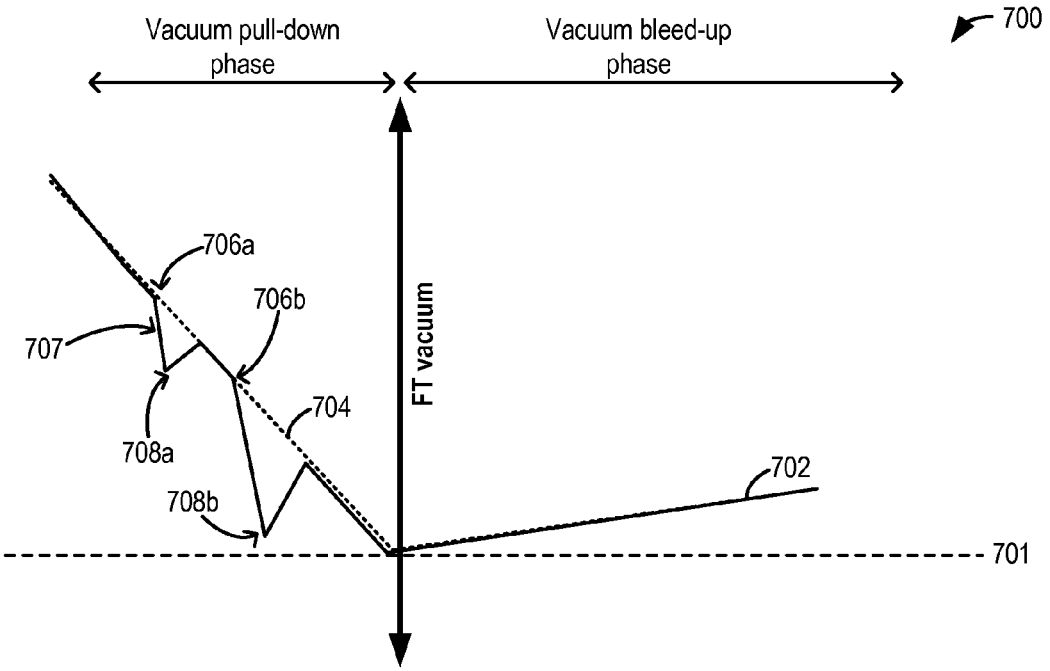

Map 700 of FIG. 7 shows yet another example change in fuel tank vacuum at plot 702 during a vacuum pull-down and bleed-up phase of a leak test. Herein, multiple fuel tank vent valve corking and uncorking events occur during the vacuum pull-down phase, and the vent valve remains uncorked during the vacuum bleed-up phase. In particular, when engine intake vacuum is applied on the fuel tank to pull down vacuum to threshold vacuum level 701, a vacuum pull-down rate is higher than a threshold rate for a duration in the middle of the vacuum pull-down phase. Segment 706*a* shows a first region of the vacuum pull-down phase where vacuum is pulled down faster than a threshold rate, substantially at a purge line vacuum level 707, while an actual fuel tank vacuum (plot 704, dotted line) is much lower. In response to the higher than threshold vacuum pull-down rate, it may be determined that a first unintended fuel tank vent valve closing has occurred at 706*a*. Then, in response to a sudden inflection in fuel tank vacuum, it may be determined that the vent valve has uncorked. Specifically, segment 708*a* shows a first region of the vacuum pull-down phase where vacuum suddenly changes from being higher than the threshold rate to being lower than the threshold rate, and gradually returning towards a fuel tank vacuum level.

Segment 706*b* shows a second region of the vacuum pull-down phase where vacuum is pulled down faster than the threshold rate. In response to the higher than threshold vacuum pull-down rate, it may be determined that a second unintended fuel tank vent valve closing has occurred (that is, the valve has corked for a second time). Then, in response to a sudden inflection in fuel tank vacuum, it may be determined that the vent valve has uncorked. Specifically, segment 708*b* shows a second region of the vacuum pull-down phase where the rate of change of vacuum suddenly inflects and approaches fuel tank vacuum. Thus, in the depicted example, the valve corks multiple times during the vacuum pull-down phase, and remains uncorked during the vacuum bleed-up phase. As such, this behavior will enable a normal vacuum bleed-up. However, as elaborated at FIG. 2, in response to the indication of (repeated) vent valve corking and uncorking, the leak test may be discontinued and the fuel tank vacuum bleed-up rate of plot 702 (even if normal) may not be used to identify a fuel system leak. Rather, a leak test may be reiterated.

Figure 8:
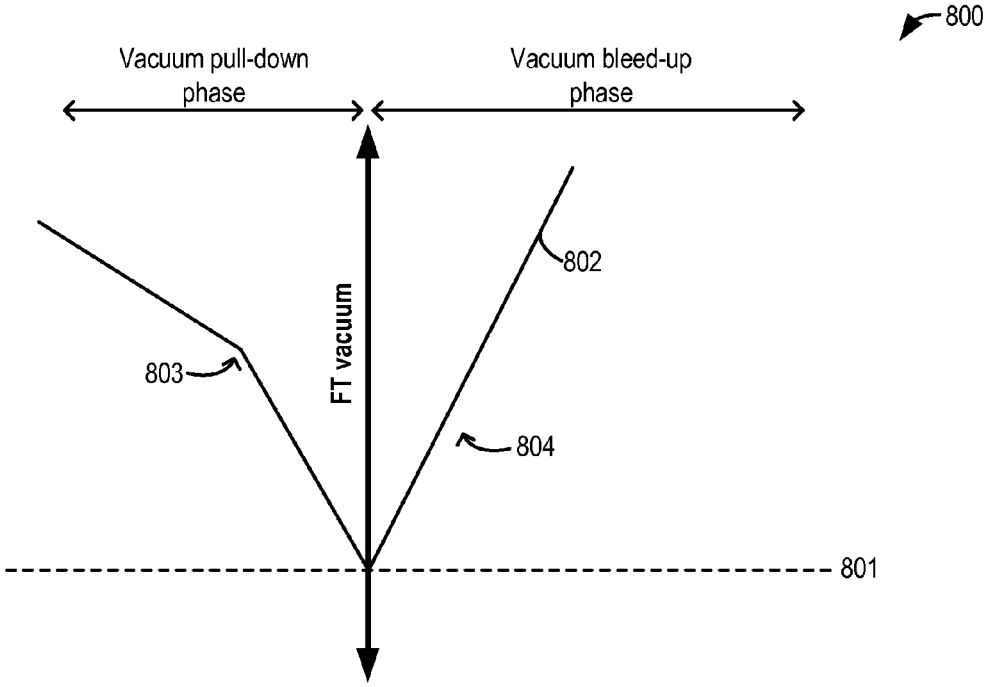

Map 800 of FIG. 8 shows still another example change in fuel tank vacuum at plot 802 during a vacuum pull-down and bleed-up phase of a leak test. Herein, during the vacuum pull-down phase, when vacuum is applied on the fuel tank to pull down vacuum to threshold vacuum level 801, a vacuum pull-down rate is higher than a threshold rate for a duration (as can be seen by comparing slope of plot 402 to slope of plot 802 during the vacuum pull-down phase of each leak test). In particular, segment 803 shows a region in the middle of the vacuum pull-down phase where vacuum is pulled down faster than a threshold rate. In response to the higher than threshold vacuum pull-down rate, it may be determined that a fuel tank vent valve has closed unintentionally and temporarily (that is, the valve has corked). In addition, high vacuum pull-down rate may trigger a blocked line code and cause vacuum to overshoot. In one example, the controller may include additional logic to confirm that a blocked line exists. The valve then remains corked during the vacuum pull-down phase. During a transition to the vacuum bleed-up phase, a sudden inflection in fuel tank vacuum occurs, indicating that the vent valve has uncorked. Specifically, segment 804 shows a region at the beginning of the vacuum pull-down phase where vacuum suddenly changes from being higher than the threshold rate to being lower than the threshold rate. As elaborated at FIG. 2, in response to the indication of vent valve corking and uncorking, the leak test may be discontinued and the fuel tank vacuum bleed-up rate of plot 802 may not be used to identify a fuel system leak. Rather, a leak test may be reiterated.

Figure 9:
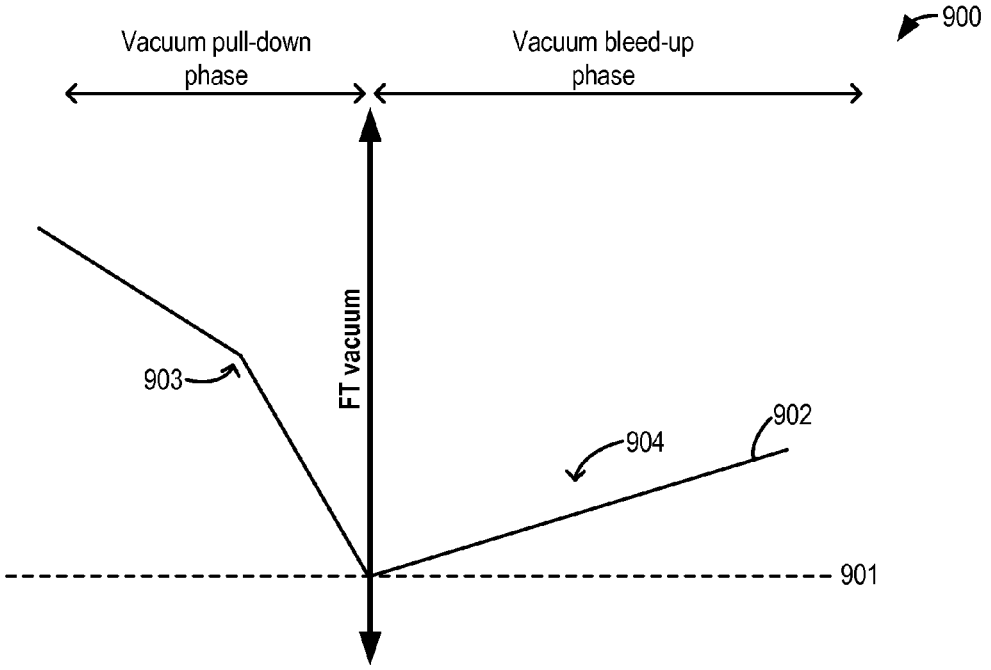

Map 900 of FIG. 9 shows a further example change in fuel tank vacuum at plot 902 during a vacuum pull-down and bleed-up phase of a leak test. Herein, during the vacuum pull-down phase, when vacuum is applied on the fuel tank to pull down vacuum to threshold vacuum level 901, a vacuum pull-down rate is higher than a threshold rate for a duration (as can be seen by comparing slope of plot 402 to slope of plot 902 during the vacuum pull-down phase of each leak test). In particular, segment 903 shows a region in the middle of the vacuum pull-down phase where vacuum is pulled down faster than a threshold rate. In response to the higher than threshold vacuum pull-down rate, it may be determined that a fuel tank vent valve has closed unintentionally and temporarily (that is, the valve has corked). Herein the valve remains corked during the remainder of the vacuum pull-down phase as well as during the subsequent vacuum bleed-up phase. As such, this behavior could result in a false pass if a leak is present on the tank side and/or may trigger a blocked line code. As elaborated at FIG. 2, in response to the indication of vent valve corking, the leak test may be discontinued and the fuel tank vacuum bleed-up rate of plot 902 may not be used to identify a fuel system leak. Rather, a leak test may be reiterated.

Figure 10:
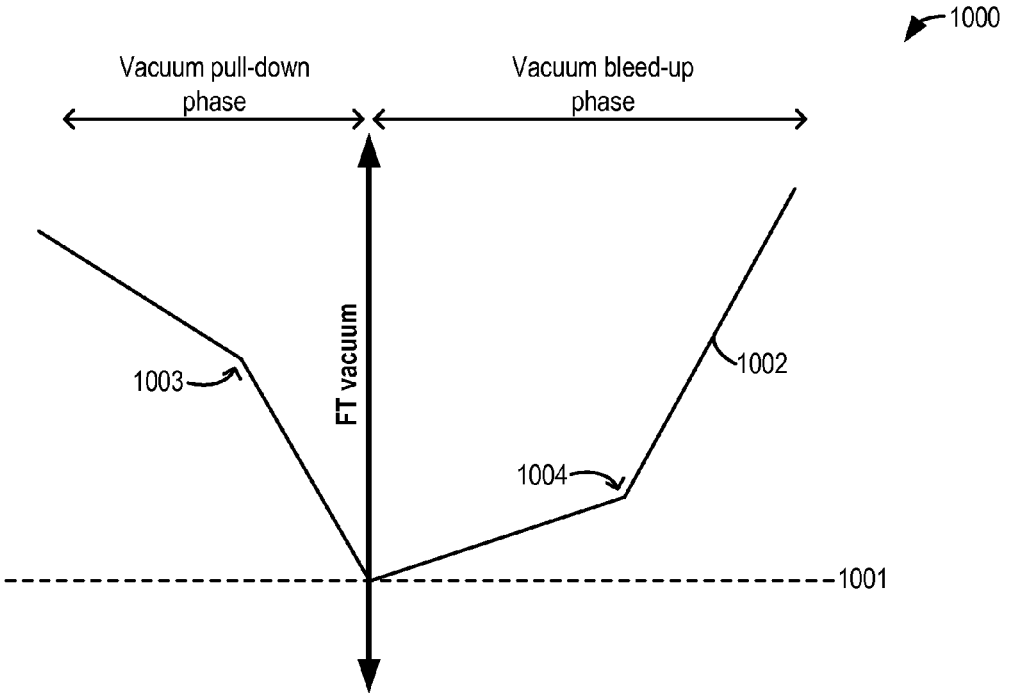

Map 1000 of FIG. 10 shows another example change in fuel tank vacuum at plot 1002 during a vacuum pull-down and bleed-up phase of a leak test. Herein, during the vacuum pull-down phase, when vacuum is applied on the fuel tank to pull down vacuum to threshold vacuum level 1001, a vacuum pull-down rate is higher than a threshold rate for a duration (as can be seen by comparing slope of plot 402 to slope of plot 1002 during the vacuum pull-down phase of each leak test). In particular, segment 1003 shows a region in the middle of the vacuum pull-down phase where vacuum is pulled down faster than a threshold rate. In response to the higher than threshold vacuum pull-down rate, it may be determined that a fuel tank vent valve has closed unintentionally and temporarily (that is, the valve has corked). In addition, high vacuum pull-down rate may trigger a blocked line code and cause vacuum to overshoot. The valve then remains corked during the remainder of the vacuum pull-down phase as well as during a transition to the vacuum bleed-up phase. In the middle of the vacuum bleed-up phase, a sudden inflection in fuel tank vacuum occurs, indicating that the vent valve has uncorked. Specifically, segment 1004 shows a region in the middle of the vacuum bled-up phase where vacuum suddenly inflects. As elaborated at FIG. 2, in response to the indication of vent valve corking and uncorking, the leak test may be discontinued and the fuel tank vacuum bleed-up rate of plot 1002 may not be used to identify a fuel system leak. Rather, a leak test may be reiterated.

Figure 11:
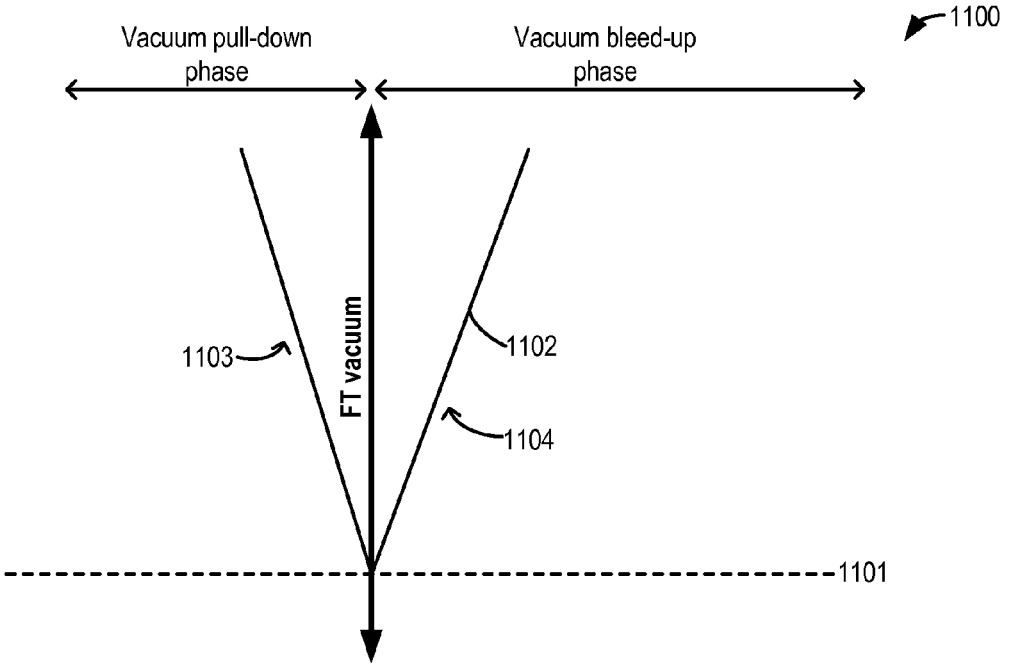

Map 1100 of FIG. 11 shows yet another example change in fuel tank vacuum at plot 1102 during a vacuum pull-down and bleed-up phase of a leak test. Herein, during the vacuum pull-down phase, when vacuum is applied on the fuel tank to pull down vacuum to threshold vacuum level 1101, a vacuum pull-down rate is higher than a threshold rate for a duration (as can be seen by comparing slope of plot 402 to slope of plot 802 during the vacuum pull-down phase of each leak test). In particular, segment 1103 shows that vacuum is pulled down faster than a threshold rate from the beginning of the vacuum pull-down. In response to the higher than threshold vacuum pull-down rate, it may be determined that a fuel tank vent valve has closed unintentionally and temporarily (that is, the valve has corked). In addition, high vacuum pull-down rate may trigger a blocked line code and cause vacuum to overshoot. The valve then remains corked during the vacuum pull-down phase. During a transition to the vacuum bleed-up phase, a sudden inflection in fuel tank vacuum occurs, indicating that the vent valve has uncorked. Specifically, segment 1104 shows a region at the onset of the vacuum pull-down phase where vacuum suddenly inflects. As elaborated at FIG. 2, in response to the indication of vent valve corking and uncorking, the leak test may be discontinued and the fuel tank vacuum bleed-up rate of plot 1102 may not be used to identify a fuel system leak. Rather, a leak test may be reiterated.

Figure 12:
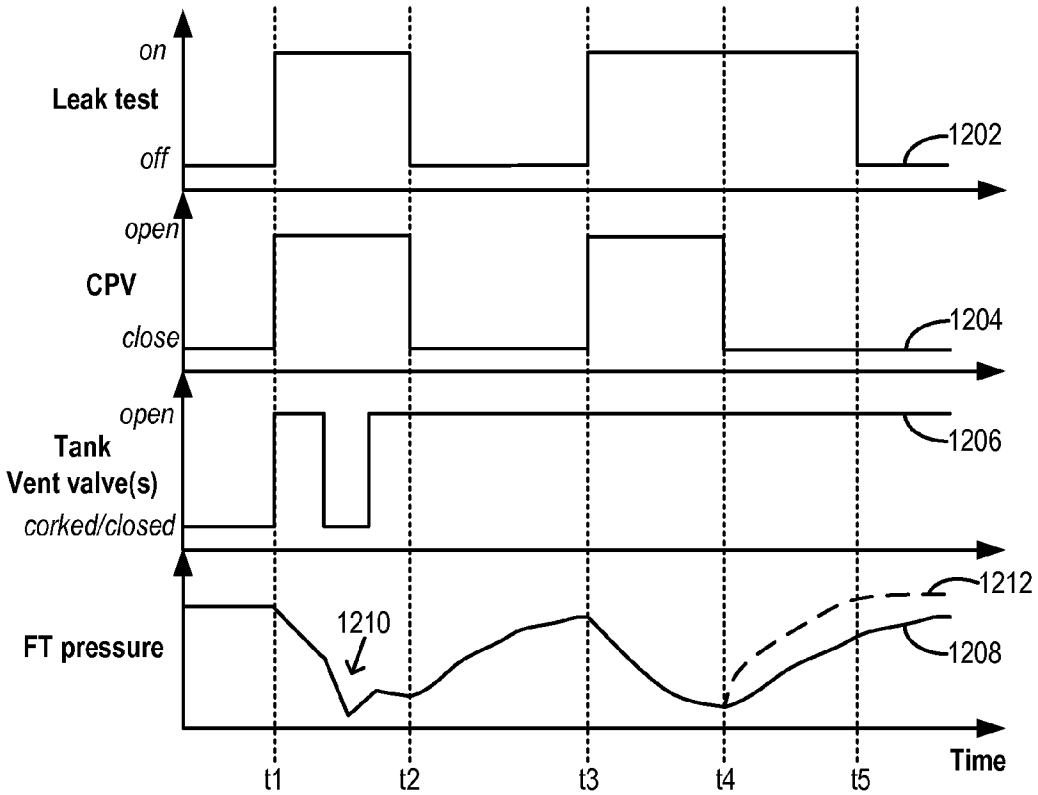
FIG. 12 shows an example fuel system leak test with unintended temporary opening of a fuel tank vent valve during the leak test.

Now turning to FIG. 12, example fuel system leak test operations are depicted. Map 1200 depicts a status of a fuel system leak test (on or off) at plot 1202, a status of a canister purge valve (open or closed) coupled between an engine intake manifold and a fuel system canister at plot 1204, a status of a fuel tank vent valve (open or closed/corked) at plot 1206, and changes in a fuel (FT) pressure at plot 1208.

Prior to t1, a vehicle engine may be running to propel the vehicle. The canister purge valve (CPV) may be closed since engine-on leak test conditions are not met. At t1, in response to leak test conditions being met, a first leak test may be initiated (plot 1202) and the canister purge valve may be opened (plot 1204) to pull down engine intake vacuum in the fuel tank. As such, during the leak test, one or more passive fuel tank vent valve(s) may be expected to be open (plot 1206). As vacuum is applied on the fuel tank, a fuel tank pressure (plot 1208) may start to decrease. A vacuum pull-down phase of the leak test may be performed between t1 and t2 wherein a fuel tank pressure is lowered to a target pressure (or vacuum) level.

During this first vacuum pull-down (between t1 and t2), a fuel tank pressure inflection may be experienced, as indicated at 1210. In particular, a rate of vacuum pull-down may become elevated in the middle of the vacuum pull-down phase (that is, vacuum is drawn at higher than a threshold rate). The elevated vacuum pull-down rate may continue for a duration of the vacuum pull-down. Then, the vacuum pull-down rate may just as suddenly inflect back towards the original rate of vacuum pull-down (that is lower than the threshold rate). In response to the pressure inflection during this first vacuum pull-down, unintended temporary closing of the tank vent valve and subsequent re-opening of the vent valve may be indicated (plot 1206). To reduce the possibility of false leak detection, at t2, in response to the indication, the canister purge valve may be closed (plot 1204) and a canister vent valve may be opened, releasing vacuum from the fuel tank. Consequently a fuel tank pressure may bleed-up (between t2 and t3) and stabilize towards atmospheric pressure (plot 1208). In addition, the leak test may be discontinued (plot 1202). Specifically, an engine controller may not identify fuel system leaks based on the first fuel tank vacuum bleed-up (between t2 and t3) immediately following the first vacuum pull-down (between t1 and t2).

After the first fuel tank vacuum bleed-up is completed, at t3, a leak test may be reinitiated (plot 1202). Therein, at t3, the purge valve may be re-opened (plot 1204) to once again pull down engine intake vacuum in the fuel tank (plot 1208). The vacuum pull-down phase of the leak test may continue from t3 to t4 to draw a threshold amount of vacuum on the fuel tank. During the vacuum pull-down between t3 and t4, no fuel tank pressure inflections may be experienced. Accordingly, it may be determined that the fuel tank vent valves (that were assumed to be open) are open and no valve corking has occurred (plot 1206). In response to no pressure inflection during the vacuum pull-down of the reinitiated leak test, at t4, the purge valve may be closed to isolate the fuel tank and initiate a vacuum bleed-up phase of the leak test. Accordingly, a fuel tank pressure may start to bleed-up towards atmospheric pressure. A fuel system leak may then be identified based on the rate of vacuum bleed-up between t4 and t5. Specifically, in response to a rate of vacuum bleed-up being slower than a threshold rate (plot 1208), it may be determined that there is no fuel system leak. In comparison, if the rate of vacuum bleed-up is faster than a threshold rate (plot 1212, dashed lines), it may be determined that there is a fuel system leak.

In this way, a fuel system leak may be completed and a fuel system leak may be identified based on a vacuum bleed-up rate only if no pressure inflections are experienced during the leak test. By disregarding fuel tank vacuum bleed-up data if fuel tank vent valve corking occurs, and further resuming original fuel system settings to reattempt a leak test, false positive leak detections caused by pressure inflections can be reduced.

It will be appreciated that while the above example depicts identifying fuel tank vent valve corking based on pressure inflections experienced during a vacuum pull-down phase, in still other examples, fuel tank vent valve corking may also be identified based on pressure inflections experienced during a vacuum bleed-up phase. For example, a controller may open a purge valve to pull down engine intake vacuum in a fuel tank, and after applying the vacuum, close the purge valve to isolate the fuel tank and release vacuum. In response to a pressure inflection during a first vacuum bleed-up, the controller may not identify fuel system leaks based on the first vacuum bleed-up. Further, the controller may indicate an unintended temporary closing of a mechanical vent valve coupled to the fuel tank. In comparison, in response to no pressure inflection during a second vacuum bleed-up, the controller may identify fuel system leaks based on the second vacuum bleed-up. Further, in response to the pressure inflection during the first vacuum bleed-up, and after releasing the vacuum, the controller may re-open the purge valve to pull down engine intake vacuum in the fuel tank, after the vacuum pull-down, close the purge valve to re-isolate the fuel tank. In response to no pressure inflection during the vacuum pull-down, the controller may identify fuel system leaks based on the third vacuum bleed-up immediately following the vacuum pull-down.

In this way, pressure inflections and changes in vacuum pull-down and bleed-up rates experienced during a leak test may be correlated with momentary and unintentional closing of a fuel tank vent valve due to external sources, such as vehicle maneuvers. By disregarding leak test data if valve corking occurs, and reiterating a new leak test, elevated vacuum bleed-up rates resulting from the temporary valve corking may not be incorrectly identified as a fuel system leak. By reiterating the leak test, reliability and accuracy of fuel system leak diagnostics is improved.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described diagnostic routines. The subject matter of the present disclosure includes all novel and non-obvious combinations and sub-combinations of the various systems and configurations, and other features, functions, and/or properties disclosed herein.

The invention claimed is:

1. A method for a vehicle fuel system, comprising:

during a fuel system leak test, and in response to unintended temporary closing of a mechanical valve coupled to a fuel tank, not completing the fuel system leak test.

2. The method of claim 1, wherein the fuel system leak test includes, closing a vent valve coupled between the fuel system canister and atmosphere;

opening a purge valve coupled between a fuel system canister and an engine intake;

applying engine intake vacuum to the fuel tank with the mechanical valve open; and following the applying, isolating the fuel tank by closing the purge valve with the mechanical valve still open, monitoring a vacuum bleed-up in the fuel tank, and indicating a fuel system leak based on a rate of vacuum bleed-up.

3. The method of claim 2, wherein an identification of unintended temporary closing of the mechanical valve is based on one or more inflections in fuel tank pressure during the applying of vacuum to the fuel tank, or one or more inflections in fuel tank pressure during the vacuum bleed-up.

4. The method of claim 3, wherein the identification is further based on a rate of vacuum pull-down during the applying of vacuum to the fuel tank and a rate of vacuum bleed-up during the isolating the fuel tank.

5. The method of claim 4, wherein the identification includes indicating unintended temporary closing of the mechanical valve during the applying of vacuum to the fuel tank based on the rate of vacuum pull-down in the fuel tank being higher than a first threshold rate, and indicating unintended temporary closing of the mechanical valve during the isolating the fuel tank based on the rate of vacuum bleed-up in the fuel tank being higher than a second, different threshold rate.

6. The method of claim 5, wherein the identification further includes, indicating re-opening of the temporarily closed mechanical valve during the applying of vacuum based on a change in the rate of vacuum pull-down, and indicating re-opening of the temporarily closed mechanical valve during the isolating the fuel tank based on a change in the rate of vacuum bleed-up.

7. The method of claim 2, wherein not completing the fuel system leak test includes closing the purge valve, opening the vent valve; and resuming fuel system settings from before the leak test was initiated, and not indicating a fuel system leak based on the rate of vacuum bleed-up during the monitoring.

8. The method of claim 7, further comprising, after resuming fuel system settings, re-opening the purge valve, re-closing the canister vent valve, re-applying engine intake vacuum to the fuel tank with the mechanical valve open, following the re-application, re-isolating the fuel tank by closing the purge valve with the mechanical valve still open, re-monitoring the vacuum bleed-up, and in response to no unintended temporary closing of the mechanical valve, indicating a fuel system leak based on the rate of vacuum bleed-up during the re-monitoring.

9. The method of claim 1, wherein the fuel system leak test is performed while the vehicle is moving, and the unintended temporary closing of the mechanical valve is caused by sources external to the fuel system including vehicle maneuvers performed while the vehicle is moving.

10. The method of claim 9, wherein the vehicle maneuvers include vehicle turns at vehicle speeds higher than a threshold speed, vehicle turns at higher than a threshold turn speed, vehicle travel along an incline that is higher than a threshold grade, and vehicle travel along a track having a lower than threshold smoothness.

11. A method for a vehicle fuel system, comprising:

opening a purge valve use engine intake vacuum to pull down fuel tank;

in response to a pressure inflection during a first vacuum pull-down, closing the purge valve, releasing vacuum from the fuel tank, and not identifying fuel system leaks based on a first fuel tank vacuum bleed-up immediately following the first vacuum pull-down; and in response to no pressure inflection during a second vacuum pull-down, closing the purge valve to isolate the fuel tank, and identifying fuel system leaks based on a second fuel tank vacuum bleed-up immediately following the second vacuum pull-down.

12. The method of claim 11, further comprising, in response to the pressure inflection during the first vacuum pull-down, and after the first fuel tank vacuum bleed-up, opening the purge valve to apply engine intake vacuum to the fuel tank during a third vacuum pull-down, and after the third vacuum pull-down, closing the purge valve to isolate the fuel tank, and in response to no pressure inflection during any discrete number of vacuum pull down, identifying fuel system leaks based on vacuum bleed-up immediately following the variable number of vacuum pull-down.

13. The method of claim 12, further comprising, in response to the pressure inflection during the first vacuum pull-down, indicating unintended temporary closing of a mechanical vent valve coupled to the fuel tank.

14. A method for a fuel system coupled to a vehicle engine, comprising:

opening a purge valve to pull down engine intake vacuum in a fuel tank;

after applying the vacuum, closing the purge valve to isolate the fuel tank and release vacuum;

in response to a pressure inflection during a first vacuum bleed-up, not identifying fuel system leaks based on the first vacuum bleed-up; and in response to no pressure inflection during a second vacuum bleed-up, identifying fuel system leaks based on the second vacuum bleed-up.

15. The method of claim 14, further comprising, in response to the pressure inflection during the first vacuum bleed-up, and after releasing the vacuum, re-opening the purge valve to pull down engine intake vacuum in the fuel tank, after the vacuum pull-down, closing the purge valve to re-isolate the fuel tank, and in response to no pressure inflection during the vacuum pull-down, identifying fuel system leaks based on a third vacuum bleed-up immediately following the vacuum pull-down.

16. The method of claim 15, further comprising, in response to the pressure inflection during the first vacuum bleed-up, indicating unintended temporary closing of a mechanical vent valve coupled to the fuel tank.

17. A vehicle fuel system, comprising:

an engine including an intake manifold;

a fuel tank coupled to the intake manifold via a canister, the fuel tank including a mechanical vent valve;

a purge valve coupled between the intake manifold and the canister and configured to enable an intake manifold vacuum to be applied on the fuel tank via the canister;

a canister vent valve coupled to the canister and configured to isolate the fuel system from atmosphere; and a controller with computer readable instructions for, closing the canister vent valve;

opening the purge valve with the mechanical vent valve assumed open to pull down a threshold amount of intake manifold vacuum on the fuel tank;

after vacuum pull-down, closing the purge valve to bleed-up vacuum from the fuel tank;

in response to a pressure inflection during the vacuum pull-down, indicating unintended temporary closing of the mechanical vent valve and not identifying a fuel system leak based on the vacuum bleed-up; and in response to no pressure inflection during the vacuum pull-down, identifying a fuel system leak based on the vacuum bleed-up.

18. The system of claim 17, wherein not identifying a fuel system leak based on the vacuum bleed-up includes disregarding data from the vacuum bleed-up, closing the purge valve, and resuming fuel system settings from before the vacuum pull-down.

19. The system of claim 18, further comprising, after resuming fuel system settings, re-opening the purge valve to reapply the threshold amount of intake manifold vacuum on the fuel tank, re-closing the canister vent valve and in response to no pressure inflection during the vacuum reapplication, closing the purge valve to bleed-up vacuum from the fuel tank, and identifying a fuel system leak based on the vacuum bleed-up following the vacuum reapplication.

20. The system of claim 19, wherein indicating unintended temporary closing of the mechanical vent valve includes indicating temporary closing of the vent valve due to a vehicle maneuver.

* * * * *